United States Patent [19]

Van Hemel

[11] Patent Number: 4,607,593

[45] Date of Patent: Aug. 26, 1986

[54] APPARATUS FOR PROCESSING ARTICLES IN A CONTROLLED ENVIRONMENT

[75] Inventor: Gilbert O. E. Van Hemel, Weert, Netherlands

[73] Assignee: U.S. Philips Corporation, New York, N.Y.

[21] Appl. No.: 679,330

[22] Filed: Dec. 7, 1984

[30] Foreign Application Priority Data

Dec. 23, 1983 [NL] Netherlands ..... 8304421

[51] Int. Cl.[4] ..... C23C 13/08

[52] U.S. Cl. ..... 118/719; 118/729; 118/733

[58] Field of Search ..... 118/719, 729, 733

[56] References Cited

U.S. PATENT DOCUMENTS 4,338,883 7/1982 Mahler ..... 118/719

4,501,766 2/1985 Suzuki et al. ..... 118/733 X

*Primary Examiner*—James R. Hoffman

*Attorney, Agent, or Firm*—Paul R. Miller

[57] ABSTRACT

The apparatus comprises an endless tunnel having a wall provided with openings giving access to processing chambers in a locked chamber which has a panel sealing the apparatus from the external environment. A conveyor which follows a closed path is arranged in the tunnel and is provided with seats for containers with articles to be processed and transport means for introducing articles carried by the conveyor into positions opposite to a chamber into a respective chamber. The apparatus has structure by which the environments in the tunnel and in each of the chambers can be controlled. The chambers can each be sealed from the tunnel in a vacuum-tight manner. By means of this apparatus articles, which are screened from the surroundings in a vacuum-tight manner, can be subjected in a controlled environment to a variety of processing steps.

9 Claims, 1 Drawing Figure

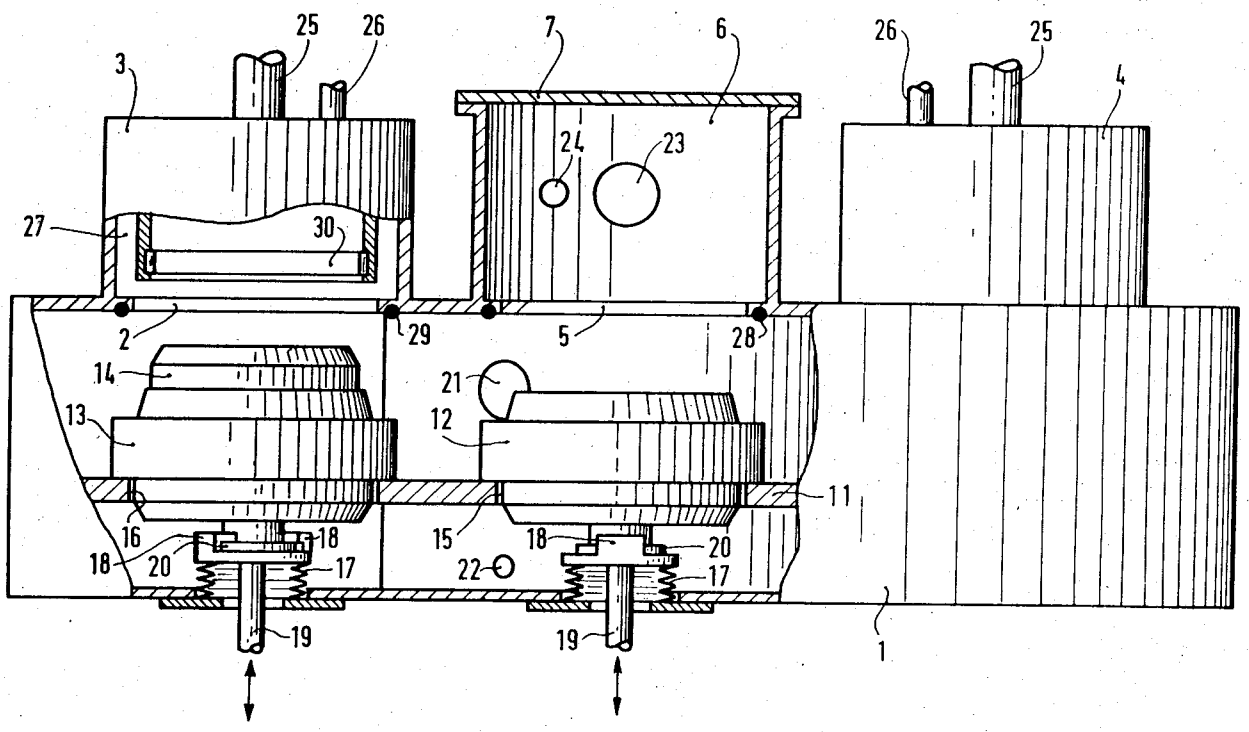
1
2
3
4
5
6
7
11
12
13
14
15
16
17
18
19
20
21
22
23
24
25
26
27
28
29
30

APPARATUS FOR PROCESSING ARTICLES IN A CONTROLLED ENVIRONMENT

The invention relates to apparatus for processing articles in a controlled environment, comprising a tunnel whose wall is provided with an opening which gives access to a chamber which is connected to the tunnel in a vacuum-tight manner and in which a processing step can be carried out, a conveyor present in the tunnel for conveying the articles through the tunnel, which conveyor has seats for receiving holders that can support the articles, transport means by which the articles supported by a holder, carried by the conveyor into a position opposite to the opening in the wall of the tunnel, can be introduced into the chamber and recovered from the chamber into the tunnel, and means by which the controlled environment is created in the chamber.

Such an apparatus is known from IBM Technical Disclosure Bulletin, 13 No. 3,748 (August, 1970).

The known apparatus comprises a linear tunnel open at both ends and subdivided into zones which are connected to a roughing pump or a high-vacuum pump. A conveyor is arranged in the tunnel and can be moved in a reciprocatory manner in the tunnel with such a fit that a small vacuum leakage is present between the tunnel wall and the conveyor. A processing chamber merges into the tunnel between two adjacent high-vacuum zones. The environment in this chamber is determined by the environment in the tunnel.

This known apparatus has the disadvantage that there is an essentially open communication between the processing chamber and the surroundings of the apparatus. Additionally, the size of this open communication is subjected to variation due to wear. Another disadvantage is that the known apparatus is not suitable for performing several processing steps simultaneously, the less so when these processing steps have to be carried out in greatly different environments.

In certain circumstances it is of major importance that articles are processed in the absence of oxygen and/or water, in the presence of only very small quantities thereof.

The invention has for its object to provide apparatus in which the disadvantages are avoided, especially an apparatus of the kind mentioned in the opening paragraph, in which it is possible to subject articles to various processing steps in controlled environments while sealed in a vacuum-tight manner from the outside atmosphere.

According to the invention this object is achieved in apparatus of the kind defined in the opening paragraph, characterized in that the tunnel is endless and the conveyor follows a closed path, the tunnel has in its wall several openings which each give access to a respective processing chamber which is connected to the tunnel in a vacuum-tight manner, and an opening giving access to a lock chamber connected to the tunnel in a vacuum-tight manner and in which articles can be locked through;

in that the apparatus can be sealed in a vacuum-tight manner from its surroundings by means of a panel in an outside wall of the lock chamber;

in that the chambers can be sealed in a vacuum-tight manner from the tunnel and in that the lock chamber, the processing chambers and the tunnel each have means by which a controlled environment can be created therein. When the conveyor is rigid, the path of the conveyor is a circle. When a chain conveyor is used, the path of the conveyor may be, for example, substantially polygonal.

In the apparatus according to the invention, the lock chamber can be sealed from the tunnel and hence from the processing chambers, so that when the panel in the outside wall of the lock chamber is opened to remove finished articles from the apparatus and/or to introduce articles to be processed into it, the controlled environments in the tunnel and in each processing chamber are maintained. When the panel in the outside wall of the lock chamber has been closed again, a controlled environment can be created again in the lock chamber, which is, for example, the environment prevailing in the tunnel, before open communication is established between the lock chamber and the tunnel. Due to the presence of a lock chamber, after the lock chamber has been opened to the outside atmosphere, only a comparatively small proportion of the internal volume, of the apparatus, i.e. the volume of the lock chamber, needs to be reconditioned.

Due to the fact that the processing chambers can be sealed from the tunnel and have means for creating a particular controlled environment within each chamber, while the articles are being processed, an environment can prevail in the processing chambers which differs from that in the tunnel and can, moreover, be different for each individual processing chamber, even if these chambers are located very close to each other. As a result, several processing steps can be carried out simultaneously in the apparatus which each require specific conditions with respect to temperature, gas pressure and gas composition.

In contrast with the known apparatus with its initially calibrated open communications with the external atmosphere, the apparatus according to the invention can be sealed in a vacuum-tight manner from the external atmosphere, as a result of which a very high degree of purity of the environments in the apparatus can be obtained.

In a very favourable embodiment, all of the processing chambers and the lock chamber can be kept sealed at the same time in a vacuum-tight manner from the tunnel. This affords the advantage that the time required for locking articles, for moving processed articles from the lock chamber to the outside and for introducing articles to be processed into the lock chamber can be utilized for processing articles in the various processing chambers.

In the processing chambers the environments are created which are required for the relevant processing steps insofar as these environments differ from the environment in the tunnel, with which the processing chambers were in open communication before they were sealed. Subsequently, the processing steps are carried out and finally, insofar as the environments in the chambers differ from that in the tunnel, the same environment as that prevailing in the tunnel is provided in the processing chambers.

An atmospheric gas pressure is adjusted in the lock chamber, after which the panel in the external wall of the chamber is opened. When the lock chamber has been closed again, after processed articles have been carried to the outside and articles to be processed have been introduced, the environment prevailing in the tunnel is created in the lock chamber.

In a favourable embodiment, the opening in the wall of the tunnel giving access to the lock chamber can be sealed in a vacuum-tight manner by a seat for a holder of the conveyor. The processed articles can then be removed together with the holder from the lock chamber.

Also openings giving access to processing chambers can be sealed by the respective seats. Alternatively, it is possible for such openings to be sealed by means of the respective holder that can support the articles. In a modification, openings giving access to processing chambers can be sealed both by means of a respective holder and by means of a respective seat. Thus, a double seal can be obtained.

In a favourable embodiment, the openings in the wall of the tunnel are situated above the conveyor and means are provided below the conveyor for lifting the holders, or the holders and the seats, and for introducing the articles supported by the holders into the respective chambers. These means comprise, for example, a set of bellows which is connected to the tunnel in a vacuum-tight manner and which can be lengthened, for example, by pressurized gas supplied from the outside.

The apparatus is suitable for carrying out a variety of processing steps on a variety of articles. As examples can be mentioned the application of layers to substrates by vapour deposition, the term "vapour deposition" denoting all kinds of processes in which material is depositioned from the gaseous phase; the manufacture of bodies sealed in a vacuum-tight manner, such as reed contacts, and, especially, gas-filled discharge lamps, such as high-pressure sodium or high-pressure metal halide lamps.

An embodiment of apparatus according to the invention is shown in the single FIGURE of the drawing in side elevation, partly broken away.

In the FIGURE, an endless tunnel 1 has in its wall several openings 2 (only one of which is shown), which each give access to a processing chamber 3 and 4, respectively, which is connected to the tunnel in a vacuum-tight manner and in which articles can be subjected to a processing step, and an opening 5 giving access to a lock chamber 6 which is connected to the tunnel 1 in a vacuum-tight manner and in which articles are locked between the apparatus and the outside environment. The apparatus can be sealed from its surroundings in a vacuum-tight manner by means of a panel 7 in the outside wall of the lock chamber 6.

A conveyor 11, shown in sectional view in the FIGURE, which has the form of a circular ring, is arranged in the tunnel. The conveyor 11 has seats 12, 13 for receiving holders 14 which can support the articles to be processed. The seats 12, 13 are arranged in holes 15 and 16, respectively, in the conveyor 11.

The apparatus has transport means whereby an article present in a holder 14 can be introduced into a chamber 6, 3 and thence (back) into the tunnel 1. In the apparatus shown, the transport means comprise a set of bellows 17, a respective claw 18 and a respective rod 19 of a pneumatic or hydraulic piston not shown, co-operating therewith. The claw 18 grips around a collar 20 at the seat 12, 13.

The apparatus has means for creating therein conditioned environments. The tunnel 1 has a connection 21 to a vacuum pump and a gass supply lead 22. The lock chamber 6 has a connection 23 to a vacuum pump and a gas supply lead 24 and the processing chambers 3, 4 each have a connection 25 to a vacuum pump and a gas supply lead 26. The processing chamber 3 is double-walled and has means (not shown in the drawing) for conditioning the space 27 between the two walls.

The chambers 6 and 3 have sealing rings 28, 29, which can cooperate with the seats 12, 13, while the processing chamber 3 has a sealing band 30 which can co-operate with the holder 14.

The apparatus shown has six chambers: a lock chamber 6 and five processing chambers, (only two of which, 3 and 4, are shown). The apparatus may be used, for example, for manufacturing high-pressure discharge lamps having a ceramic lamp vessel.

The apparatus may be utilized, for example, as follows. The tunnel and the chambers are evacuated via the leads 21, 23 and 25 and are rinsed with inert gas supplied via leads 22, 24 and 26 until the desired standard environment in the apparatus is attained. Subsequently, the transporting means 17, 18, 19 are actuated and the seats 12, 13 are lifted until they close the openings 2, 5 to the processing chambers 3, 4 and the lock chamber 6, respectively, and thus separate the chambers from the tunnel 1. The holder 14 then provides a second seal of the chamber 3 from the tunnel 1 by means of the sealing band 30. Gas is admitted to the lock chamber 6 via the tube 24 until atmospheric pressure is attained, after which the panel 7 is opened and a holder 14 supporting articles to be processed, in this case ceramic tubes provided on one side with an electrode and sealing material, and in addition second electrodes and sealing material, is arranged in the seat 12. The panel 7 is then closed and the environment prevailing in the tunnel 1 is provided in the lock chamber 6.

The transporting means 17, 18, 19 then carry the seats 12 and 13 with their contents into the tunnel 1 and the conveyor 11 is advanced by one position so that the seat 12 becomes located with its holder opposite to the opening 2 giving access to the chamber 3. The seats 12, 13 are then lifted and the openings 2, 5 giving access to the chambers 3 and 6, respectively, are sealed.

The environment required for the processing step to be effected in the processing chamber 3 can then be created and the processing step can be effected. The double seal between the processing chamber 3 and the tunnel 1 provides an additional safety margin in the case of large environmental differences, for example differences in temperature, gas pressure and gas composition.

In the processing chamber 3, the ceramic tubes can be sealed at their first ends in a vacuum-tight manner by causing the sealing material to melt and then to solidify. In the next processing chambers, the ceramic tubes can be inverted, solid or liquid constituents of the filling can be metered via the still open other ends and the second electrodes and the sealing material can be provided. In the last processing chamber 4, the tubes can be sealed at their second ends in a gas atmosphere corresponding to the gas atmosphere that has to prevail in the tubes.

What is claimed is:

1. Apparatus for processing articles in controlled environments comprising a tunnel whose wall is provided with an opening which gives access to a chamber which is connected to the tunnel in a vacuum-tight manner and in which a processing step can be carried out, a conveyor present in the tunnel for transporting the articles through the tunnel, which conveyor has seats for receiving holders that can support the articles, transport means by which the articles supported by a holder which is carried by the conveyor into a position opposite to the opening in the wall of the tunnel, can be introduced into the chamber and recovered from the chamber into the tunnel and means by which a controlled environment can be created in the chamber, characterized in that the tunnel is endless and the conveyor follows a closed path, the tunnel has in its wall several openings each giving access to a respective processing chamber which is connected to the tunnel in a vacuum-tight manner, and an opening giving access to a lock chamber which is connected to the tunnel in a vacuum-tight manner and in which articles can be locked through;

in that the apparatus can be sealed from its surroundings in a vacuum-tight manner by means of a panel in the outside wall of the lock chamber;

in that the chambers can be sealed from the tunnel in a vacuum-tight manner; and in that the lock chamber, processing chambers and the tunnel each have means by which a controlled environment can be created therein.

2. Apparatus as claimed in claim 1, characterized in that the openings in the wall of the tunnel can be kept sealed at the same time.

3. Apparatus as claimed in claim 1 or 2, characterized in that the opening in the wall of the tunnel giving access to the lock chamber can be sealed in a vacuum-tight manner by means of a seat for a holder of the conveyor.

4. Apparatus as claimed in claim 3, characterized in that each opening in the wall of the tunnel giving access to a respective processing chamber can be sealed in a vacuum-tight manner by means of an opposed holder.

5. Apparatus as claimed in claim 3, characterized in that the openings in the wall of the tunnel are situated above the conveyer and in that lifting means are provided below the conveyor for lifting the sealing means and for introducing the articles supported by the holders into a respective processing chamber or lock chamber.

6. Apparatus as claimed in claim 1 or 2, characterized in that the openings in the wall of the tunnel giving access to the processing chambers can be sealed in a vacuum-tight manner by means of a respective seat for a holder of the conveyor.

7. Apparatus as claimed in claim 6, characterized in that each opening in the wall of the tunnel giving access to a respective processing chamber can be sealed in a vacuum-tight manner by means of an opposed holder.

8. Apparatus as claimed in claim 7, characterized in that the openings in the wall of the tunnel are situated above the conveyor and in that lifting means are provided below the conveyor for lifting the sealing means and for introducing the articles supported by the holders into a respective processing chamber or lock.

9. Apparatus as claimed in claim 6, characterised in that the openings in the wall of the tunnel are situated above the conveyor and in that lifting means are provided below the conveyor for lifting the sealing means and for introducing the articles supported by the holders into a respective processing chamber or lock.

* * * * *